United States Patent [19]

Vercillo et al.

[11] Patent Number: 4,848,797

[45] Date of Patent: Jul. 18, 1989

[54] BINDER COVER AND BINDING SYSTEM

[75] Inventors: Alfredo J. Vercillo, Harwood Heights; Roger M. Scharer, Des Plaines, both of Ill.

[73] Assignee: General Binding Corporation, Northbrook, Ill.

[21] Appl. No.: 171,767

[22] Filed: Mar. 22, 1988

[51] Int. Cl.[4] ..... B42D 1/00; B42D 3/00; B42F 13/40

[52] U.S. Cl. ..... 281/21.1; 281/36; 402/4

[58] Field of Search ..... 281/3 R, 15 R, 21 R, 281/36; 402/4, 70, 74, 75; 412/8, 902

[56] References Cited

U.S. PATENT DOCUMENTS

| | | | |
|---|---|---|---|
| 1,805,314 | 5/1931 | Morton | 281/36 |
| 1,978,754 | 10/1934 | Marienthal | 281/36 |
| 2,097,626 | 11/1937 | Lesti | 402/4 |
| 3,840,254 | 10/1974 | Shatzkin | 281/21 R |
| 3,964,769 | 6/1976 | Shatzkin | 281/21 R |
| 4,019,758 | 4/1977 | Heller, Jr. et al. | 281/21 R |
| 4,141,100 | 2/1979 | Domroe et al. | 281/21 R |

FOREIGN PATENT DOCUMENTS

| | | | |
|---|---|---|---|
| 2546822 | 12/1984 | France | 281/21 R |

*Primary Examiner*—Frank T. Yost
*Assistant Examiner*—Paul M. Heyrana, Sr.

[57] ABSTRACT

There is disclosed herein a binder cover system for binding loose pages to a cover. The cover includes a spine and a front and back cover hingedly connected thereto, there being applied an electrically conductive layer to an insulator layer which carries an electrically conductive layer and which is secured to said spine and a heat-activatable adhesive layer to said conductive layer. Electrically conductive rivet-like means extend through said spine insulating layer and said electrically conductive layer and are connected by said electrically conductive layer.

11 Claims, 1 Drawing Sheet

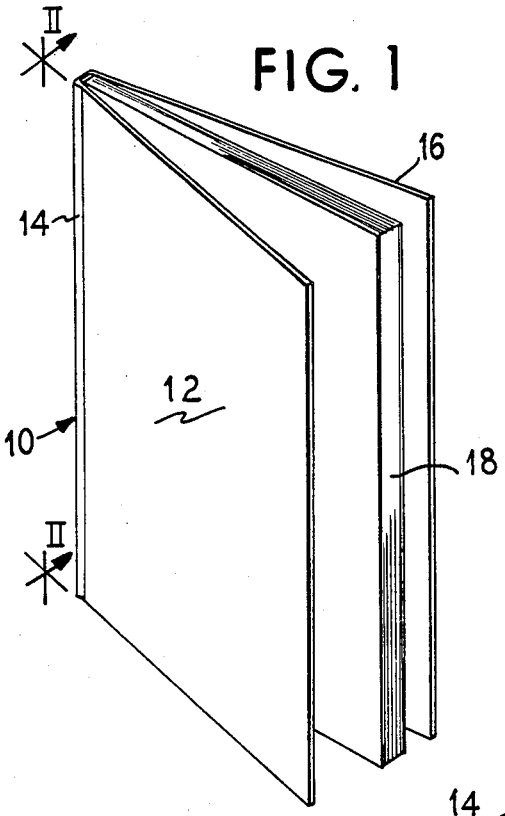
FIG. 1
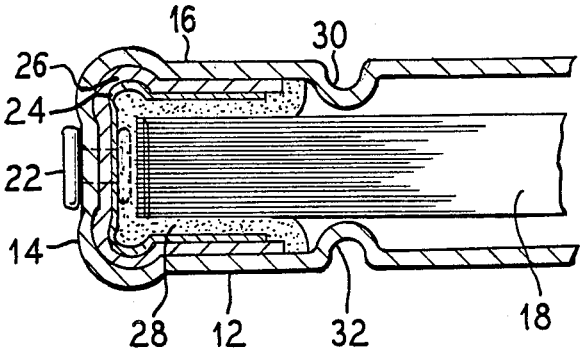
FIG. 3
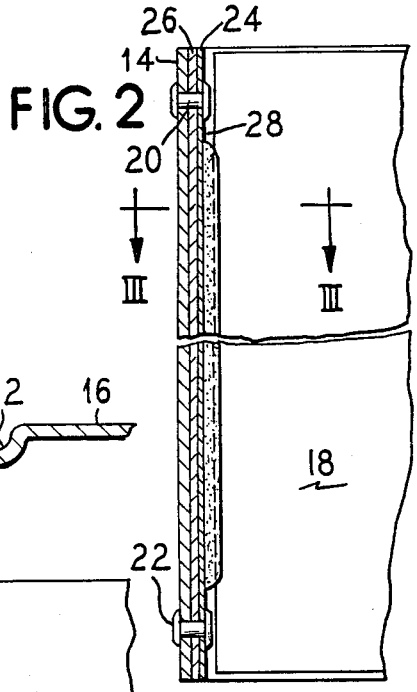
FIG. 2
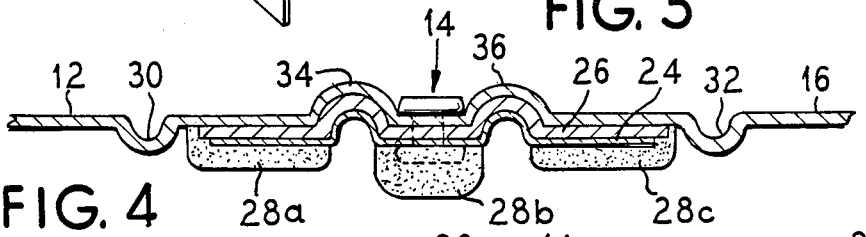
FIG. 5
FIG. 4
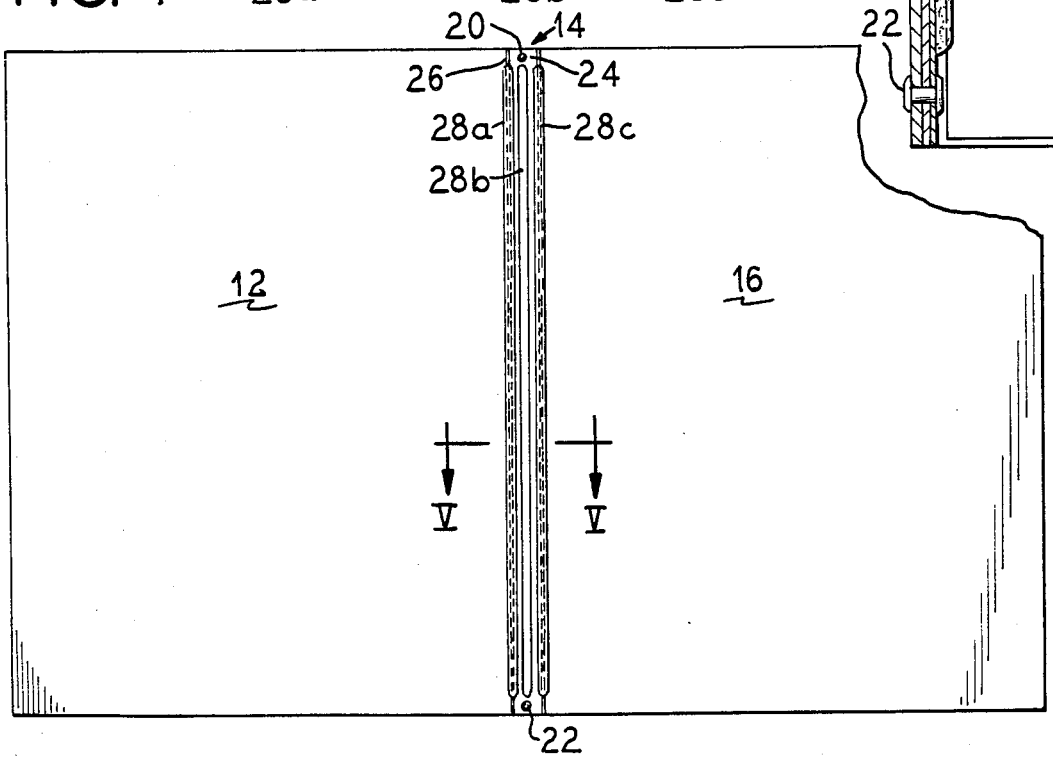

BINDER COVER AND BINDING SYSTEM

BACKGROUND OF THE INVENTION

This invention relates to a binder cover, and more particularly, to a heat-activated binding system for loose sheets of paper or like material.

It is desirable, for reports and other types of documents, to bind a group of loose sheets of paper in a binder cover. In one form this could be hole-punched papers in a ring binder, such as a three-ring notebook. In another known form, a heat-staked post arrangement is used. In this arrangement binding strips are applied along a side edge of opposite sides of the sheets, and the strips and text are bound together by posts passing through the text and binding strips, which posts are heat-staked to the binding strips.

Another alternative is to provide a heat-activated adhesive in an electrically operated system, whereby the text material is bound to a cover. One such system is shown in French Publication No. 2546822, Registration No. 8309098. The French system discloses a binder having a spine and front and back covers, loose sheets to be bound therein and electrodes and a heat-activated adhesive along the spine. The adhesive is activated by heat generated through the electrodes which extend outwardly from the binder for connection to an electrical energy supply. In other words, the electrodes extend outwardly of the spine for connection with various electric contacts. The extension outwardly of the binder means that the electrodes are obstrusive, need to be cut off or otherwise removed, may be unsafe and may present appearance problems.

It is the object of this invention to provide a binder system in which, inter alia, the electrodes do not extend outwardly of the binder itself, which is electrically safe and which is commercially acceptable.

These and other objects of this invention will become apparent from the following description, drawings and appended claims.

SUMMARY OF THE INVENTION

There is disclosed herein a binder cover having a heat-activated adhesive and electrical means for generating the heat to activate the adhesive all along the spine of a binder cover. The electrical means are within the binder cover. The electrical means include a pair of electrically conductive rivet assemblies spaced from each other and which connect to an electrically conductive layer on the spine and onto which the heat-activated adhesive is applied. Passage of current through the electrically conductive layer generates heat, which in turn causes the heat-activated adhesive to flow for binding. A heat-insulator, pressure-sensitive-backed paper layer may be used to carry the conductive layer and secure it to the spine.

BRIEF DESCRIPTION OF THE DRAWINGS

FIG. 1 is a perspective view showing a binder cover with front and back covers and a sheaf of loose papers bound therein;

FIG. 2 is a vertical sectional view taken along line 2—2 of FIG. 1 showing the spine of the binder assembly;

FIG. 3 is a sectional and fragmentary view taken along line 3—3 of FIG. 2 showing the loose pages as bound to the spine and heat-activated adhesive of th binder;

FIG. 4 shows an opened and unassembled binder cover with the heat-activated adhesive insulator and electrical layers applied thereto; and FIG. 5 is an enlarged sectional view showing the spine portion of the binder and the respective electrically conductive insulator and adhesive layers.

DESCRIPTION OF THE PREFERRED EMBODIMENT

Referring now to FIG. 1, there is shown a one-piece binder cover or assembly 10, which includes a front cover 12, a spine 14, and the back cover 16. A sheaf of loose papers 18, which may include text material, are positioned in the cover for binding along the left side edge as shown. Generally the binder cover is cardboard and the paper 18 is a normal bond paper used for preparation of text or typed materials.

As shown in FIG. 2, a pair of spaced electrically conductive rivets 20 and 22 extend through the spine and contact the conductive layer 24 that is mounted to the spine by a paper, heat-insulating, pressure sensitive layer 26. A hot-melt or heat-activated adhesive layer 28 is carried on the conductive layer 24 between the rivets 20 and 22. All of these elements are within the binder and do not extend externally thereof. The sheaf of loose papers 18 is shown in the bound position.

Referring now to FIG. 3, the binder cover 10 is shown in enlarged detail and is pressed to provide various score lines or depressions for hinging and bending. The depressions 30 and 32 permit the covers 12 and 16 to be opened or bent along the hinge connections made by the depressions. The individual sheets of paper 18 are shown bound to the spine and between the hinges. More particularly, the heat-activated adhesive layer 28 is shown in a melted condition in which adhesive has flowed between the sheets of the paper 18. The electrically conductive layer 24 is seen in engagement with the heat-activated adhesive on one side and the paper insulator backing 26 on the other side for securing the conductive layer to the binder. One of two spaced rivets 22 is shown, and it is understood that electrical current may pass from outside the binder through the conductive rivet 22 to the electrically conductive layer 24 for heating the heat-activated adhesive layer and then to the other rivet.

Referring now to FIG. 4, the binder is shown in an open condition with covers 12 and 16 and spine 14. The rivets 20 and 22 are adjacent the top and bottom ends of the spine respectively and are spaced from one another. The heat-activated adhesive 28 is applied in three rows, a pair of outer rows **28*a* and 28*c* and a raised central row 28*b* between the rivets. The electrically conductive layer 24 is seen extending from rivet to rivet, as well as the larger insulator carrier 26** which carries the electrically conductive layer.

Referring now to FIG. 5, the covers 12 and 16 and spine 14 are shown. The binder depressions 30 and 32 are also seen, as well as the spine-forming scores or protuberances 34 and 36. The heat-activated adhesive rows **28*a*, 28*b* and 28*c* are spaced from one another and positioned between the respective depressions and protuberances. For example, the adhesive row 28*c* is positioned between depression 32 and protuberance 36. The conductive layer 24 is carried on the paper, heat-insulating layer 26. Furthermore, the outer adhesive rows 28*a*** and 28c cover the outer edges of the conductive layer 24.

The completed binder assembly is fabricated using the following steps: (1) the electrically conductive layer or ink is applied by screening onto the paper, heat insulating and pressure sensitive adhesive layer; (2) the screened ink-insulator/adhesive layer is adhered to the binder spine; (3) the various lines are scored into the cover to form the spine and hinges; (4) the hot melt adhesive is applied to the conductive ink; and (5) the spaced rivets are then fastened in place through the conductive layer, insulator/adhesive layer and binder.

The paper layer 26 is a heat insulator and has a pressure sensitive backing. The conductive ink or conductive layer is applied to the non-adhesive side of the paper layer. One particular paper layer may be purchased from Fasson, an Avery International Company, 7670 Auburn Road, Painesville, Ohio, and is identified as 60# U.L. Litho/S-730/46# Fastrip.

The conductive layer must conduct electricity and generate heat for melting the adhesive. The layer can be a film conductor or a conductive ink as, for example, the type purchased from The DuPont Company, Wilmington, Del., and identified as Polymeric Thick Film Materials for Circuitry, Conductor 5008. Other inks are available from other sources. This ink is screened onto or applied to the adhesive-backed paper insulator layer and the paper then adhered to the binder spine. This ink is useful for fabricating low voltage circuitry on flexible substrates. The important feature is that the ink is conductive and that it has resistance to generate sufficient heat for causing the adhesive 28 to flow.

The heat-activated adhesive is selected on the basis that (1) at ambient temperatures it is fundamentally solid and will not flow, while (2) at elevated temperatures it will flow and be tacky and sticky. However, the adhesive must be activatable at a temperature less than the scorching temperature of paper so as to avoid any fires or the like resulting from overheating of the adhesive. Thus the desired minimum flow temperature is greater than ambient and the maximum temperature is less than the scorching temperature of paper.

Heat-activated adhesives which are satisfactory include hot melt adhesives as sold by National Starch and Chemical Corporation, Finderne Avenue, P.O. Box 6500, Bridgewater, N.J. 08807 and identified as Flex Back 34-1113.

In operation it can be seen that a sheaf of papers is positioned against the spine of the binder and an electrical current passed between the rivets 20 and 22 so that a current passes through the electrically conductive ink or layer 24, which in turn heats the hot melt adhesive 28, which flows in the paper edges so as to bind the edge of the papers 18 thereto. As an example, a temperature between 160° F. and 375° F. is acceptable.

Although the invention has been described with respect to preferred embodiments, it is not to be so limited as changes and modifications can be made which are within the full intended scope of the invention as defined by the appended claims.

I claim as my invention:

1. A binder cover for use in binding paper therein comprising:

a spine and a front cover and a back cover hingedly connected to said spine;

an electrically conductive resistive layer means applied along the spine on the inside surface thereof;

a heat-activated adhesive layer means applied upon said electrically conductive resistive layer means; and a pair of electrically conductive contact means spaced from each other and extending through said electrically conductive resistive layer means and said binder; said electrically conductive resistive layer means, said heat-activated adhesive means, and said contact means being entirely within the length of said spine.

2. A binder cover as in claim 1, wherein there is further provided a heat insulating layer having a pressure sensitive adhesive backing for securement to said binder spine on one side and said conductive resistive layer means on the other side.

3. A binder cover as in claim 2, wherein each of said electrical contact means are rivets, each of which extends through said spine, said insulator layer means and said conductive layer so as to permit electric current flow from outside the binder to said electrical conductive layer means.

4. A binder cover in claim 1, wherein said electrically conductive resistive layer means converts electrical energy to heat upon electrical current flowing therethrough, wherein said heat-activated adhesive layer means is flowable in response to heat generated by said conductive layer means.

5. A binder cover as in claim 4, wherein said heat-flowable adhesive layer means flows at a temperature greater than 160? F., but less than 375° F.

6. A binder cover as in claim 1, wherein said electrically conductive resistive layer means electrically connects directly to said spaced electrical contact means.

7. A binder cover apparatus as in claim 1, wherein said binder cover includes hinge-like depression means along each side of said spine and a pair of spine-forming protuberance adjacent said spine, and said heat-activated adhesive layer means is provided in three rows positioned between each of said protuberances and each of said protuberances and depressions.

8. A binder cover as in claim 1, wherein said heat-activated adhesive layer means extends between said spaced electrical contact means and is supported on said conductive resistive layer.

9. A binder cover as in claim 1, wherein said heat-activated adhesive layer means is flowable at a temperature greater than ambient but less than the scorching temperature of paper.

10. The binder as in claim 1, and in combination therewith, loose sheets of paper adhered thereto, said heat-activatable adhesive engaging the outer pages and positioned between the sheets thereof.

11. An apparatus as in claim 1, wherein said contact means extends through the adhesive means and spine.

* * * * *